US005213326A

United States Patent [19]

Rundell et al.

[11] Patent Number: 5,213,326

[45] Date of Patent: May 25, 1993

[54] BINGO BOARD ORGANIZING DEVICE

[76] Inventors: Linda N. Rundell, 17911 Cali Dr.; Robert Troxclair, c/o 17911 Cali Dr., both of Houston, Tex. 77090

[21] Appl. No.: 875,333

[22] Filed: Apr. 29, 1992

[51] Int. Cl.[5] ..... A63F 3/06; B65D 85/20

[52] U.S. Cl. ..... 273/148 A; 273/269; 273/309

[58] Field of Search ..... 273/269, 309, 148 A, .273/148 R, 285; 206/315.1, 579

[56] References Cited

U.S. PATENT DOCUMENTS 4,241,921 12/1980 Miller ..... 273/148 A 5,050,740 9/1991 Lucero ..... 273/285

*Primary Examiner*—Benjamin H. Layno

[57] ABSTRACT

A bingo sheet organizing device having a first panel with a size suitable for receiving a bingo sheet, a second panel having a size suitable for receiving a bingo sheet, and a body connected in hinged relationship to an edge of the first and second panels. The first and second panels extend radially outwardly from the body. A suitable retainer is provided so as to retain the bingo sheet on each of the panels. The body is a tubular member having at least one hinge member extending outwardly therefrom. The hinge member extends generally longitudinally along the body. A handle is fastened to an exterior surface of the tubular member and extends outwardly transverse to a plane of the second panel. An elastic band extends around the first panel distal to the connection of the first panel to the body so as to receive the bingo sheet therewithin. A lip is formed along an edge of the first panel in resilient contact with the panel so as to receive an edge of the bingo sheet.

18 Claims, 3 Drawing Sheets

10
12
14
16
18
20
22
24
26
28
30
32
34
36
38
40
42
44
46
48
50
52
54
56
58
60
62
64
66
68
70
72
74
76
78
80
84
86
88
90
92
96
98
100
102
104
110
112
114
116

FIG. 5
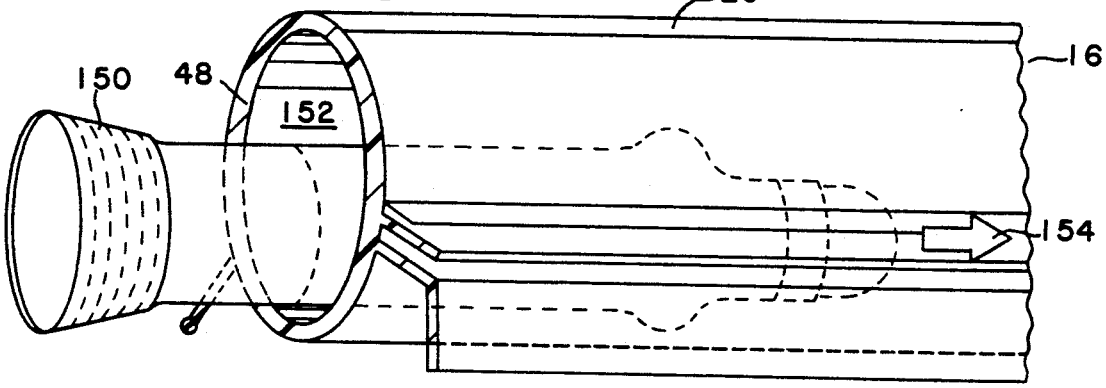
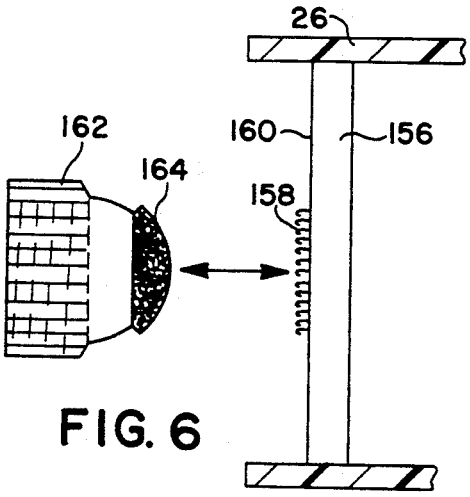
FIG. 6
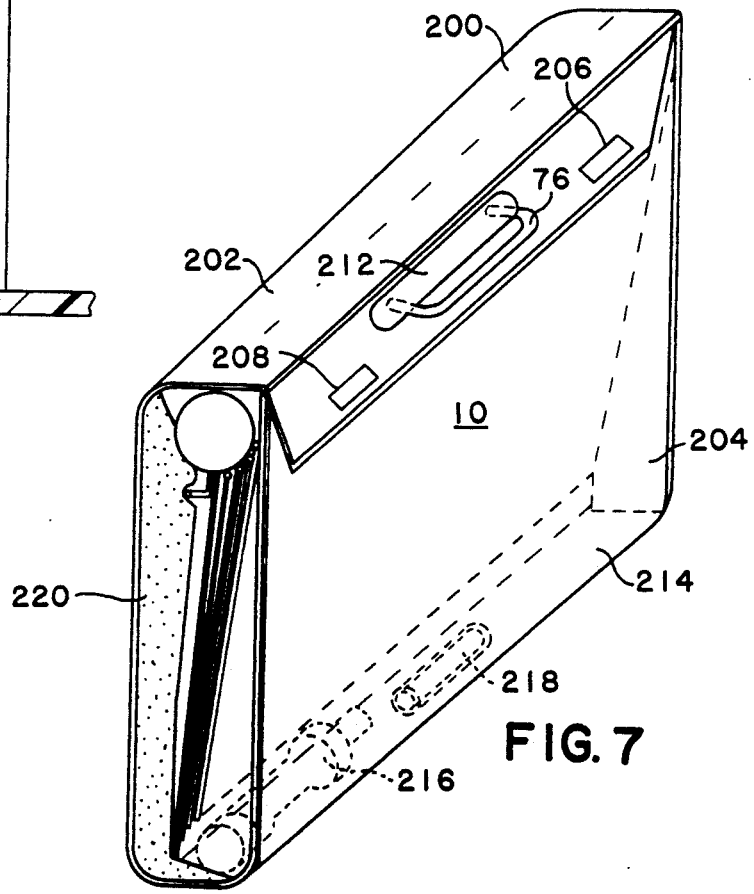
FIG. 7

BINGO BOARD ORGANIZING DEVICE

TECHNICAL FIELD

The present invention relates to devices for assisting in the playing of bingo. More particularly, the present invention relates to devices that are useful for the play of multiple sheets of bingo cards.

BACKGROUND ART

The game of bingo is a game of chance often played simultaneously by hundreds and even thousands of people. It is been one of the most popular forms of low-priced gambling in the world.

In playing bingo, which is a form of lottery, each person purchases one or more cards divided into numbers and blank squares. Random numbers, usually up to 75 or 90, are called out. The first player to achieve a card (or a line) with all of his numbers, usually 20, called, shouts "bingo!" and collects the entire stake money, usually less a specified percentage. In another popular variation, the central square on the card is free, and the first player on whose card five of the called numbers appear in a row—vertically, horizontally, or diagonally—the winner.

While bingo has always been a popular activity, a renaissance of sorts has occurred in the bingo industry characterized in that a sophisticated and serious group of players engage in bingo on a regular basis. In concert therewith, various improvements have occurred in streamlining the game to the point now where the activity is relatively fast paced (due in part the replacement of marker chips with ink markers) and the award of substantial prizes both in goods and in money. Accordingly, it is not surprising that many players play several game sheets simultaneously. In fact, the playing sheets are sold with as many as 12 distinct game faces on each sheet. It is well within the scope of most people to play two or more sheets simultaneously. With the advent of an increased number of games played simultaneously by persons, coupled with substantial increases in attendance at bingo parlors the amount of space each player is afforded has diminished somewhat over the years. Accordingly, a need exists to efficiently orchestrate the bingo playing process to maximize the ability of a player to play several sheets simultaneously in a minimal amount of playing space and time.

Various U.S. Patents have issued in the past which describe the use of devices for supporting the play of several bingo games simultaneously. U.S. Pat. No. 4,502,658, issued on Mar. 5, 1985, to Wirt et al. shows a combined sheet and marker holder for carrying, in a folded condition, and for playing bingo in an unfolded condition. This device employs legs which are positioned to give the player proper elevation for viewing the sheets while playing bingo and a clip for retaining the sheets during play. A combined handle and latch is provided so as to retain the support in a folded condition for carrying or for storage.

U.S. Pat. No. 4,948,139, issued on Aug. 14, 1990, to R. Heeszel provides a case which can be opened and expanded so as to have an enlarged playing area for bingo. A pair of swinging doors are provided adjacent to the front of the case so as to allow for the storage of different markers.

U.S. Pat. No. 5,028,048, issued on Jul. 2, 1991, to Watson et al. discloses a game carrying and playing device having a case with a surface for supporting one or more game cards. The sides of the case are of trapezoidal shape so that when the bottom is positioned on a horizontal surface, the top surface is inclined with respect to the horizontal.

U.S. Pat. No. 5,054,783, issued on Oct. 8, 1991, to Hull et al. shows a bingo caddy for transporting and containing a bingo player's paraphernalia. This includes slanted fold-out multiple playing surfaces with a holding device to hold bingo cards. The bingo caddy has a unique two section lid which folds into a compartmentalized configuration for easy access to the interior of the case.

It is an object of the present invention to provide a bingo board organizing device that enhances the ability to play multiple sheets of bingo cards.

It is another object of the present invention to provide an organizing device which can be opened and closed and manipulated, as needed, to facilitate rapid bingo play.

It is still another object of the present invention to provide an organizing device that is compatible with the use of ink daubers.

It is another object of the present invention to provide a bingo board organizing device which is easy to use, simple to manufacture, and relatively inexpensive.

These and other objects and advantages of the present invention will become apparent from a reading of the attached specification and appended claims.

SUMMARY OF THE INVENTION

The present invention is a bingo sheet organizing device comprising a first panel and a second panel, each having a size suitable for receiving a bingo sheet thereon. The first and second panels include a suitable receiving means for retaining the bingo sheet on a surface of the first and second panels. A body is connected in hinged relationship to the first panel such that the first panel is pivotable about the body relative to the second panel. The first and second panels are connected to the body so a to extend radially outwardly from the body.

The body is a tubular member having at least one hinge member extending outwardly from the body. The hinge member runs longitudinally along the body. The tubular member has a first semi-cylindrical member and a second semi-cylindrical member interconnected in edge-to-edge relationship so as to form a tubular member. This tubular member has a first open end and a second open end. A first end cap is detachably connected to the first open end of the tubular member. A second end cap is fastened to the second open end. The first and second end caps cooperate so as to close the interior of the tubular member. The first end cap is connected by a line to the tubular member. The first end cap is removable from the tubular member such that the tubular member opens to form a storage space for daubers, chips, and other items. The second end cap is affixed to the second open end. The second end cap has a hook-and-loop material VELCRO (TM) attached thereto. The VELCRO (TM) material is suitable for retaining another strip of VELCRO (TM) attached to a dauber cap or other items.

The body further includes a first leg that extends outwardly radially from the tubular member. This first leg is positioned generally opposite the hinge member. A second support leg also extends outwardly from the tubular member. The second support leg has a downwardly extending portion with an edge coplanar with a bottom edge of the first leg. The first leg and the second support leg serve to support the tubular member on a surface. A first lip extends radially outwardly from the tubular member in parallel relationship with a portion of the second support leg. The second panel has an edge which is received between the first lip member and the second support leg. A second lip member also extends radially outwardly from the tubular member and has an edge in resilient contact with a surface of the second panel. The second lip serves to retain an edge of the bingo sheet against the second panel.

The hinge member has a plurality of holes extending longitudinally on the tubular member. Each of the plurality of holes is arranged in parallel relationship to each other. The first panel has an aperture which extends along one edge. The aperture of the first panel is aligned with the plurality of holes of the hinge member. A hinge pin is provided so as to extend through the hole of the hinge member and through the aperture of the first panel.

In the complete embodiment of the present invention, a third panel, fourth panel, and a fifth panel are received by the hinge member such that these panels are pivotable about the corresponding hole and with respect to the fixed second panel. The third, fourth and fifth panels are interposed between the first and second panels.

The body has a handle which is fastened to an exterior surface of the tubular member. The handle extends outwardly generally transverse to the plane of the second panel. The handle is positioned so as to contact the first panel when the first panel is pivotted about the hinge member. The handle serves to support the first panel in a vertically upward position.

The means for retaining the bingo sheet on the surface of the panel includes an elastic band which extends around the first panel distal to the connection of the first panel with the body. The bingo sheet is received within the elastic band. The means for retaining also includes a lip which is formed along an edge of the first panel adjacent to the connection with the body. This lip has a surface in resilient contact with the first panel. The lip juxtaposes an edge of the bingo sheet against the first panel.

A tab is attached along an outer surface of the first panel so as to extend outwardly from the panel. A plurality of abutment members are affixed to at least one of the first and second panels so as to be interposed therebetween. These abutment members serve to position the first and second panels in generally parallel relationship to each other. A case is provided by the present invention which generally surrounds the first and second panels and the body. The case has a slot formed therein. The handle extends outwardly through the slot of the case.

BRIEF DESCRIPTION OF THE DRAWINGS

FIG. 5 is a perspective view of the isolated body of the present invention showing, in particular, the use of the body as a storage compartment.

FIG. 6 shows the second end of the tubular member of the body as in position for receiving an external object.

FIG. 7 is a perspective view of the case for carrying the bingo board organizing device of the present invention.

DETAILED DESCRIPTION OF THE INVENTION

Figures 1, 2:
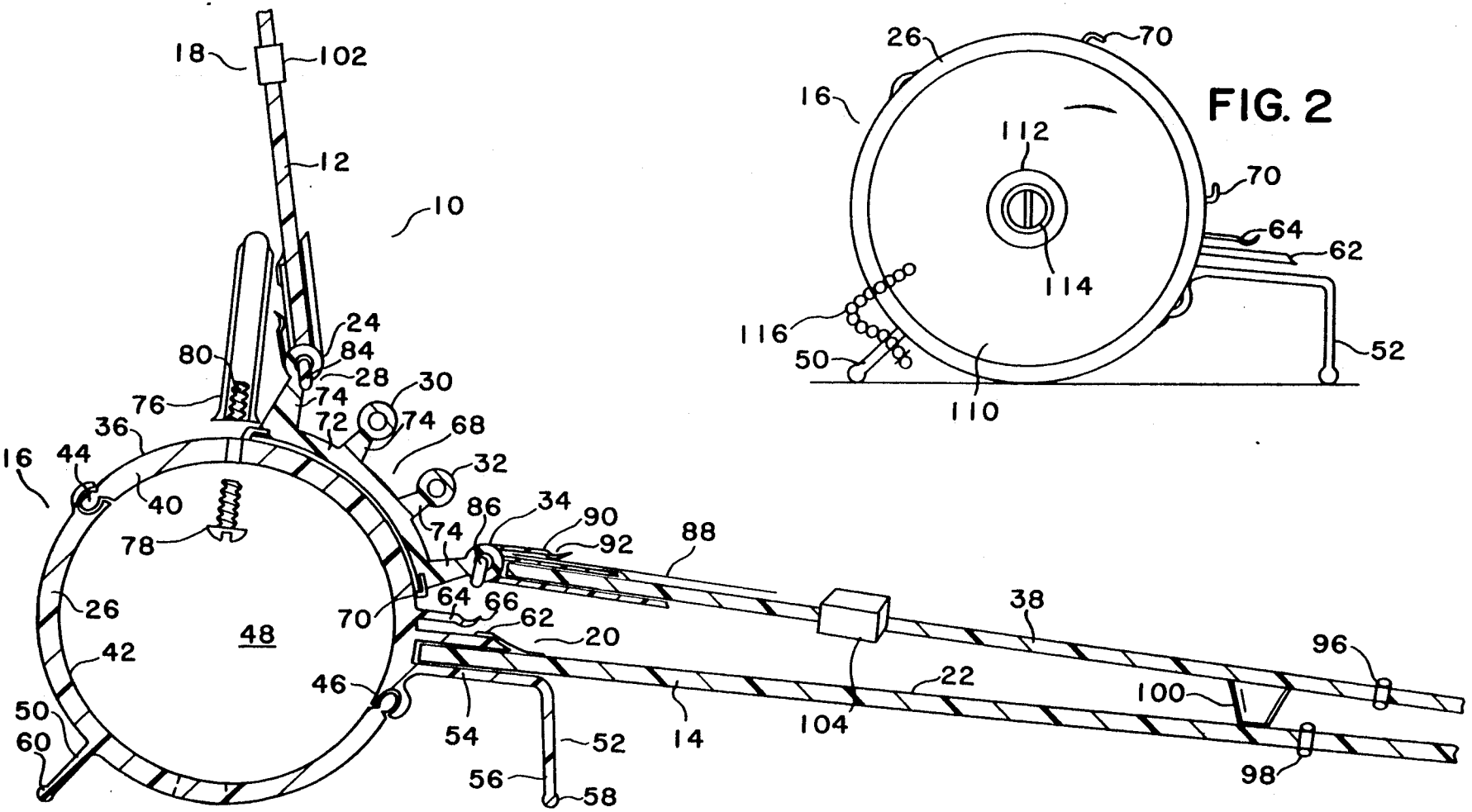
FIG. 1 is a side elevational view of the bingo board organizer in accordance with the preferred embodiment of the present invention.
FIG. 2 is an isolated side elevational view of the body of the bingo board organizing device of the present invention.

Referring to FIG. 1, there is shown at 10 the bingo board organizing device in accordance with the preferred embodiment of the present invention. The bingo board organizing device 10 comprises a first panel 12, a second panel 14, and a body 16. The first panel 12 has a size suitable for receiving a bingo sheet thereon. Similarly, the second panel 14 also has a size suitable for receiving a bingo sheet thereon. The first panel 12 includes a receiving means 18 for retaining the bingo sheet on the surface of the panel 12. The second panel 14 also includes a lip 20 as its receiving means for retaining a bingo sheet on the top surface 22 of the second panel 14. The body 16 is connected in hinged relationship to an edge of first panel 12. The first panel 12 is pivotable about the body 16 and hinge 24 such that the panel 12 pivots relative to the second panel 14. The first panel 12 and the second panel 14 extend outwardly radially from the body 16.

The panels 12 and 14 are made of a plexiglass material having a size suitable for receiving a bingo sheet having multiple cards printed thereon. Generally, panels 12 and 14 have a rectangular configuration. The panels 12 and 14 are generally flat.

The body 16 includes a tubular member 26 which has a plurality of hinge members 28, 30, 32, and 34 extending outwardly from the tubular member 26. Each of the hinges 28, 30, 32, and 34 extend generally longitudinally along the exterior surface 36 of tubular member 26. As can be seen in FIG. 1, the hinge member 28 receives the first panel 12. The hinge member 34 will also receive a third panel 38. The tubular member 26 is made up of a first semi-cylindrical member 40 and a second semi-cylindrical member 42. The first semi-cylindrical member 40 includes a male connector 44 at one end and a female connector 46 at the other end. In this manner, the first semi-cylindrical member 42 can be either slidably received, or snap fitted, with the second semi-cylindrical member 42. The joining of the semi-cylindrical members forms the tubular member 26 of the present invention. In the illustration of FIG. 1, the tubular member has a first open end 48.

A first leg 50 extends outwardly radially from the second semi-cylindrical member 42 of tubular member 26. Generally, the first leg 50 is arranged opposite to the hinge members 28, 30, 32, and 34. The leg 50 serves to support the tubular member 26 on a surface. The leg 50 also provides proper balance and resistance such that the first panel 12 can be supported in an upright position without causing the tubular member 26 to rotate about its body 16 or to tip over.

A second support leg 52 also extending outwardly from the tubular member 26. This second support leg has a radially outwardly extending portion 54 and a downwardly extending portion 56. The end 58 of the downwardly extending portion 56 of support leg 52 is generally coplanar with the end 60 of the first leg 50.

The first leg 50 and the second support leg 52 serve to properly support the device of the present invention on a level surface, such as a table in a bingo hall.

A first lip member 62 extends radially outwardly from the tubular member 26. This first lip member 62 is arranged in generally parallel relationship with the horizontal portion 54 of the second support leg 52. It can be seen that the second panel 14 is received between the first lip member 62 and the horizontal portion 54. In the embodiment shown in FIG. 1, it can be seen that the second panel 14 is maintained in relatively fixed position with respect to the body 16. The far end of the second panel 14 is also arranged generally adjacent to the surface upon which the body 16 rests. As such, the second panel 14 provides additional support to the stability of the body 16 and the attached panels. The second panel 16 may be adhesively fastened within the area between first lip member and the horizontal portion 54.

A second lip member 64 also extends radially outwardly from the first semi-cylindrical member 40 of tubular member 26. This second lip has an edge 66 which is suitable for resilient contact with a surface of a bingo sheet. In the configuration shown in FIG. 1, the top of the bingo sheet can be received between the second lip member 64 and the first lip member 62.

In FIG. 1, it can be seen that the hinge member 68 is fastened by brackets 70 to the first semi-cylindrical member 40 of the body 16. It can be seen that the hinge member 68 has a plurality of hinge holes 28, 30, 32, and 34. These hinge holes extend longitudinally along the tubular member 26. It can also be seen that the hinge holes are arranged in parallel relationship to one another. The hinge member 68 has a body 72 having the outwardly extending projections 74. Each of the outwardly extending projections 74 supports the hinge holes 28, 30, 32, and 34. In normal use, the hinge holes will be aligned with a corresponding aperture formed at the end of the panels 12 and 38, to be described hereinafter. It can be seen that each of the projections 74 is in spaced relationship to an adjacent projection. The hinge member 68 can be slidably received by brackets 70, or can be snap-fitted in position.

A handle 76 is secured by bolt 78 to the top surface of the first semi-cylindrical member 40 of tubular member 26. The bolt, or screw, 78 can extend through an opening in the tubular member 26 so as to join with a receiving thread 80 of handle 76. As can be seen, the handle 76 is affixed so as to extend generally transverse to the plane of the second panel 14. The handle 76 is positioned so as to contact the first panel 12 when the first panel is pivotted about the hinge 24. The handle 76 supports the first panel 12 in a vertically upward position, similar to that shown in FIG. 1. The handle also provides a convenient means for carrying the bingo board organizing device 10 of the present invention.

Each of the panels 12 and 38 includes an aperture running along the edge adjacent to the body 16. In relation to the hinge member 68, as shown in FIG. 1, the apertures of the panels 12 and 38 will be placed in alignment with the hinge holes 28 and 34, respectively. After these are brought into alignment, a hinge pin 84 is inserted so as to retain the first panel 12 within the hinge hole 28 of the hinge member 68. Similarly, a hinge pin 86 is inserted through the hinge hole 34 so as to secure the third panel 38 within hinge hole 34. In this arrangement, each of the panels 12 and 38 is free to pivot with respect to their hinges. As needed, additional panels can be received, in a similar manner, within hinge holes 30 and 32. The present invention is adaptable to receive a total of five panels, similar to that shown. The number of panels is not intended as a limitation on the present invention.

Each of the panels that are received by the hinge member 68 includes a suitable mechanism for retaining the bingo sheet 88 in a proper position on the surface of the panels. With reference to the third panel 38, it can be seen that a lip 90 is formed along an edge of the panel 38 adjacent to the body 16. Lip 90 has a surface 92 which is in resilient contact with the first panel 38. The lip 92 is sufficient so as to receive bingo sheet 88 in a secure fashion. The other end of bingo sheet 88 is retained in proper position by an elastic band 96 which is arranged distal to the connection of the panel 38 with the body 16. Similarly, an elastic band 98 extends around the second panel 14 so as to retain the bingo sheet in its proper position. An abutment member 100 is affixed to either the to of panel 14 or to the bottom of panel 38 so as to be interposed between the panels 14 and 38. This abutment member 100 serves to support the panels 14 and 38 in a generally parallel position relative to each other. This abutment member 100 also serves to prevent springback of the panels when the player is using an ink dauber.

In FIG. 1, it can be seen that the first panel 12 includes a tab member 102 attached along an outer edge of the first panel so as to extend outwardly from the panel 12. Similarly, the third panel 38 includes a tab 104 which extends along the outer edge of panel 38. Since the second panel 14 is fixed in position, and is the bottom panel in the configuration, there is no need for the tab member. The tabs assist in the ability to select one panel with respect to another panel. Each of the tabs is offset from the tab of an adjacent panel so that it is easy to choose the proper panel for the purposes of flipping the panels about the hinges.

FIG. 2 shows the manner in which a first end cap 110 can be fastened about the open end 48 of the tubular member 26 of body 16. In addition, FIG. 2 shows the arrangement of the body 16 without the attachment of the hinge member 68 or the panels. The end cap 110 has a knob 112 which is held in position by a bolt and nut 114. The end cap 110 is detachably mounted to the tubular member 26. It can be seen that a line 116, such as a chain, joins the end cap 110 to the first leg 50 of body 16. As such, the cap 110 can be removed so as to reveal the storage space on the interior of tubular member 26. The line 116 prevents the end cap 110 from being lost or misplaced.

FIG. 2 shows the brackets 70 in their proper position for receiving the hinge members 68. The support leg 52 is shown in coplanar arrangement with the first leg 50. Similarly, FIG. 2 shows the arrangement of the first lip member 62 in conjunction with the second lip member 64.

The body 16 can be manufactured from a long tube of extruded polyvinylchloride plastic. ABS plastic, or of aluminum. The panels of plexiglass serves an area to play six nine, or twelve face sheets of bingo paper. The lip associated with each of the panels will hold as many as ten to twelve sheets by slipping the top of the bingo paper into the "lip". The bottom of the bingo paper package is secured with a band of rubberized material that is placed completely around the papers and plexiglass panel.

Figure 3:
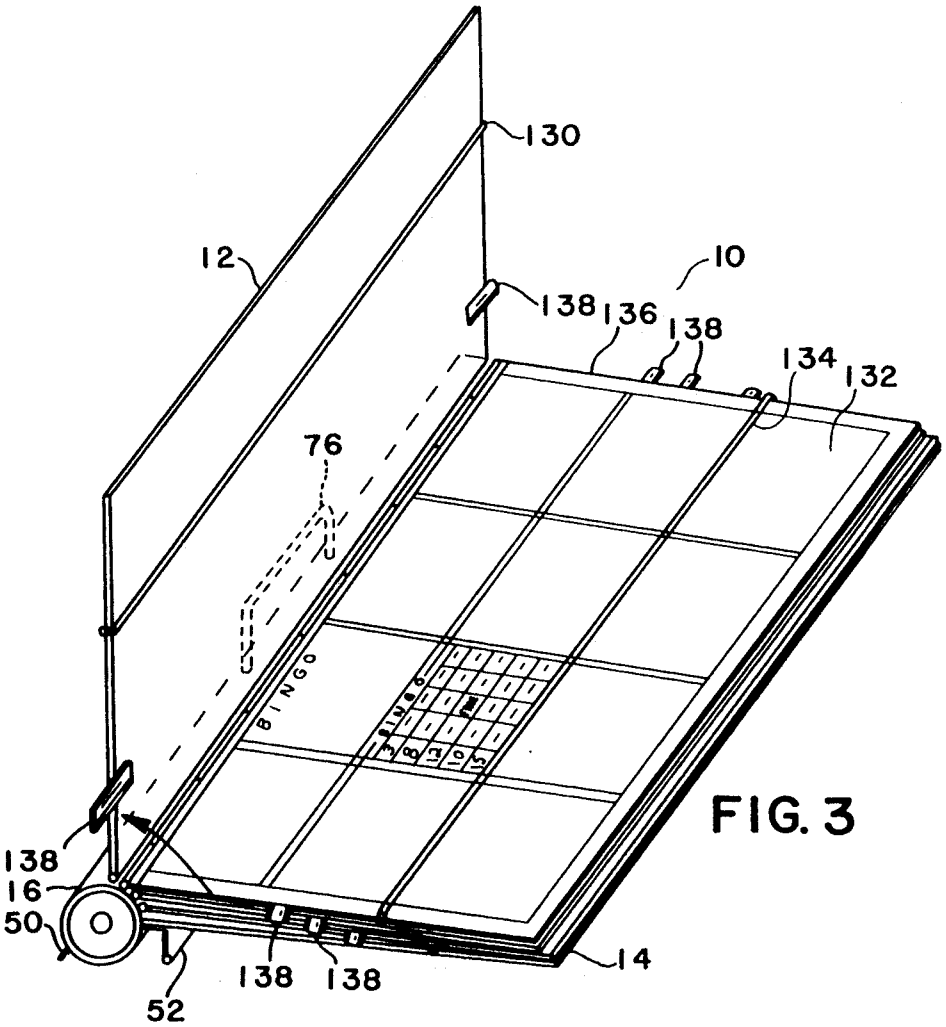
FIG. 3 is a perspective view showing the operation of the bingo board organizing device of the present invention.

FIG. 3 shows the arrangement of the device 10 in a proper condition for the playing of bingo. In FIG. 3, it can be seen that the body 16 supports the use of first panel 12, second panel 14, and a plurality of panels therebetween. In FIG. 3, it can be seen that the first panel 12 is flipped upwardly and rests in an upright position juxtaposed against the handle 76. The handle in combination with the leg 50 and 52 provides the necessary support so that the panel 12 can remain upright.

The first panel 12 includes an elastic band 130 which extends along the entire length of the panel 12. The elastic band SO can be a rubber band, or other material, having a sufficient size and resiliency so as to accommodate bingo sheets on either the top or bottom surface of panel 12. It can be seen that the bingo sheet 132 is affixed beneath the elastic band 134 on the panel 136. The bingo sheet 132 is shown as having twelve bingo cards exposed for playing. The tabs 138 on each side of each of the panels facilitate the ability to flip the panels with respect to each other. The tabs 138 make it much easier to access the proper panel for use. It can be seen in FIG. 3 that the present invention provides a compact appearance in which many bingo sheets can be utilized at the same time. As such, the present device reduces the space requirements required for the play of multiple sheets.

As one plays the game of bingo, one marks the numbers on the top face sheet attached to the first panel 12, raises it, and proceeds to mark the numbers on the next panel 136. The player continues to access the third panel, the fourth panel, and the final panel. The player may then mark the numbers next called on the face sheet secured to the last panel and play in reverse order. The handle 76 serves as a "stop" to hold the plexiglass in place while in the "up" position. The present invention organizes bingo face sheets in a compact area so as to take up less room on the bingo facility table. For example, if a player is playing forty-eight faces of bingo, the papers should cover a twenty-six inch by thirty-six inch area. The present invention, however, will only take up eighteen inches by thirteen inches of space.

Figure 4:
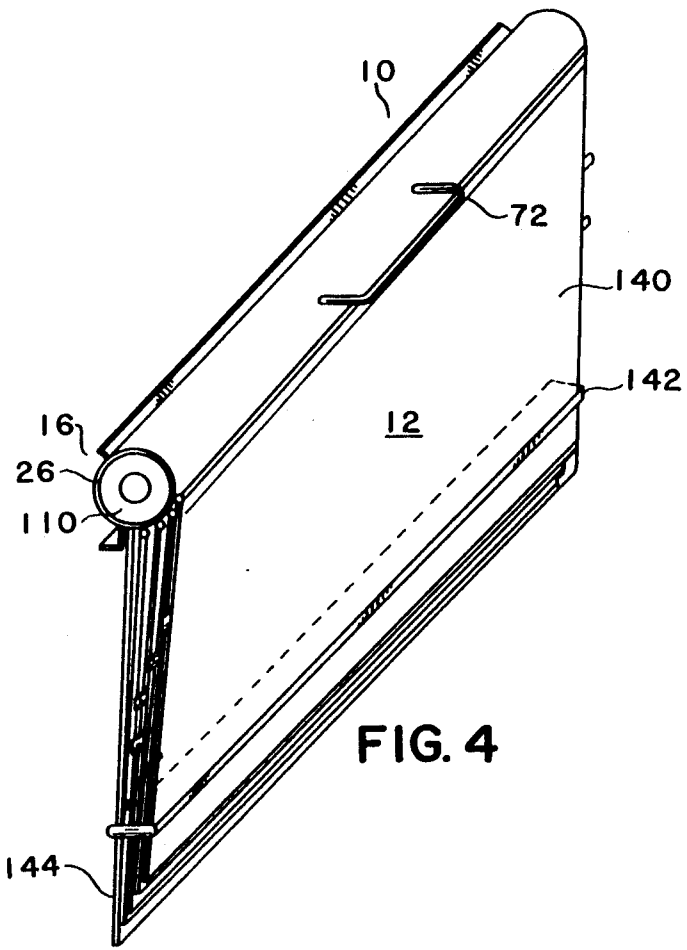
FIG. 4 is a perspective view of the folded bingo board organizing device of the present invention.

FIG. 4 shows that the bingo board organizer 10 can be arranged compactly and carried wherever needed. In FIG. 4, it can be seen that the tubular member 26 of body 16 supports the handle 76 extending horizontally outwardly. The panel 140 extends downwardly from the tubular member 26 and in a direction generally transverse to the handle 72. The end cap 110 is positioned over the open end of the tubular member 26 so as to contain any objects within the interior of the tubular member 26. An elastic band 142 extends around the top panel 12 and around the back panel 144. This secures all of the panels together in a sandwiched configuration. As such, the present invention eliminates the possibility of each of the panels swinging wildly during transport. The bingo sheets used can still be retained in their proper positions during the transport of the device 10.

FIG. 5 shows that the tubular member 26 of body 16 can serve suitably as a storage area for items, such as ink daubers 150. In conventional games of bingo, the numbers are marked with ink daubers. As such, it is important to carry such daubers to the bingo hall for use during play. The present invention is efficient an convenient by providing the storage area 152 within the interior of tubular member 16. It can be seen that the dauber 150 is simply inserted into the open end 48 of tubular member 26. The arrow 154 shows the direction of travel for storage.

The other end of the tubular member 26 of body 16 is generally permanently closed. FIG. 6 shows the arrangement of the second end cap 156 on the end of tubular member 26 opposite the open end 48. So as to provide an additional level of convenience for the players of bingo, a section of hook-and-loop material 158 is adhesively affixed to surface 160 of hinge cap 158. It can be seen that the cap 162 of a dauber has a complementary section 164 of hook-and-loop material. This section 164 of hook-and-loop material is suitably for joining with the hook-and-loop material 158 attached to end cap 156. In this manner, when the dauber 150 is in use, the end cap 162 can be easily stored by placing it on the fixed end cap 156 at the opposite end of tubular member 26.

FIG. 7 shows the carrying case 200 as used with the bingo board organizing device 10 of the present invention. It can be seen that the carrying case 200 is a generally rectangular case having a suitable storage area for accommodating the size of the device 10. The lid 202 of carrying case 200 can be fastened to the body 204 by way of VELCRO (TM) fasteners 206, 208, and 210. It can be seen that the lid 202 has a slot 212 formed therein. When the bingo board organizing device 10 is placed into the interior of the body 204, the handle 76 Will extend outwardly through slot 212. As such, the bingo board organizer 10 provides the necessary handle for its own carrying case. The VELCRO (TM) fasteners 206, 208, and 210 secure the lid 202 to the body 204.

The triangular cross-sectional of the bingo board organizer 10 fits conveniently within the interior of body 204. The narrow end of the bingo board organizer 10 leaves a sufficient amount of room at the bottom 214 of body 204 so as to allow for the storage of other items such as dauber 216 or glue 218. Various other items can also be stored within the interior of the carrying case 200.

Most bingo halls have chairs with no padding or very little padding. The chairs can be uncomfortable so that many players bring pillows to sit on. When the carrying case of the present invention is empty, it can be used as a seat cushion on the player's chair or it can be used to slip onto the back of the chair. A section of foam 220 can be included within the interior of carrying case 204 so as to provide more cushion and to also protect the board from damage during transport.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

We claim:

1. A bingo sheet organizing device comprising:

a first panel having a size suitable for receiving a bingo sheet thereon;

a second panel having a size suitable for receiving a bingo sheet thereon, said first and second panels having receiving means for retaining a bingo sheet thereon;

a body connected in hinged relationship to an edge of said first panel, said first panel pivotable about said body relative to said second panel, said first and second panels extending radially outwardly from said body;

said body comprising a tubular member having at least one hinge member extending outwardly from said body, said hinge member extending generally longitudinally along said body, said hinge member receiving said first panel; and said hinge member fastened to said tubular member, said hinge member having a plurality of holes extending longitudinally on said tubular member, each of said plurality of holes arranged in parallel relationship to each other.

2. The device of claim 1, said tubular member comprising:

a first semi-cylindrical member; and a second semi-cylindrical member interconnected in edge-to-edge relationship so as to form said tubular member.

3. The device of claim 1, said tubular member having a first open end and a second open end opposite said first open end, said body further comprising:

a first end cap detachably connected to said first open end of said tubular member; and a second end cap fastened to said second open end, said first end cap and said second end cap for closing an interior of said tubular member.

4. The device of claim 3, said first end cap having a line connected thereto, said line being connected to said tubular member, said first end cap removable from said tubular member such that said tubular member opens to form a storage space.

5. The device of claim 3, said second end cap affixed to said second open end of said tubular member, said second end cap having a surface of a hook-and-loop material attached thereto.

6. The device of claim 1, said body further comprising:

a first leg extending outwardly radially from said tubular member, said first leg positioned generally opposite said hinge member.

7. The device of claim 6, said body further comprising:

a second support leg extending outwardly from said tubular member, said second support leg having a downwardly extending portion having an edge coplanar with a bottom edge of said first leg, said first leg and said second support leg for supporting said tubular member on a surface.

8. The device of claim 7, said body further comprising:

a first lip member extending radially outwardly from said tubular member, said first lip member arranged generally parallel a portion of said second support leg, said second panel having an edge received between said first lip member and said second support leg.

9. The device of claim 8, said body further comprising:

a second lip member extending radially outwardly from said tubular member, said second lip member having an edge in resilient contact with a surface of said second panel, said second lip member for retaining a edge of the bingo sheet adjacent said second panel.

10. The device of claim 1, said first pane having an aperture extending along an edge of said first panel, said aperture of said first pane aligned with of said plurality of holes of said hinge member, said body further comprising:

a hinge pin extending through said one of said plurality of holes of said hinge member and through said aperture of said first panel.

11. The device of claim 1, said hinge member having a first hole, a second hole, a third hole, and a fourth hole, said first hole receiving said first panel such that said first panel pivots with respect to said first hole, said device further comprising:

a third panel received by said second hole such that said third panel pivots about said second hole;

a fourth panel received by said third hole such that said fourth panel pivots about said third hole; and a fifth panel received by said fourth hole such that said fifth panel pivots about said fourth hole, said third, fourth, and fifth panels interposed between said first and second panels.

12. The device of claim 1, said body further comprising:

a handle fastened to an exterior surface of said tubular member, said handle extending outwardly generally transverse to a lane of said second panel.

13. The device of claim 12, said handle positioned so as to contact said first panel when said first panel is pivotted about said hinge member, said handle supporting said first panel in a vertically upward position.

14. The device of claim 12, further comprising:

a case generally surrounding said first and second panels and said body, said case having a slot formed therein, said handle extending outwardly through said slot of said case.

15. The device of claim 1, said receiving means comprising:

an elastic band extending around said first panel distal to the connection of said first panel to said body, said elastic band for receiving the bingo sheet therewithin.

16. The device of claim 15, said receiving means further comprising:

a lip formed along an edge of said first panel adjacent the connection with said body, said lip having a surface in resilient contact with said first panel, said lip for juxtaposing an edge of the bingo sheet against said first panel.

17. The device of claim 1, further comprising:

a tab attached along an outer surface of said first panel so as to extend outwardly from said first panel.

18. The device of claim 1, further comprising:

a plurality of abutment members affixed to at least one of said first and second panels, said abutment members interposed between said first and second panels for supporting said panels in generally parallel relationship to each other.

* * * * *